US009300054B2

(12) United States Patent
Martin et al.

(10) Patent No.: US 9,300,054 B2
(45) Date of Patent: Mar. 29, 2016

(54) PRINTED CIRCUIT BOARD BASED FEED HORN

(75) Inventors: Bonnie G. Martin, Lumberton, NJ (US); Erik Lier, Newtown, PA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 268 days.

(21) Appl. No.: 13/349,504

(22) Filed: Jan. 12, 2012

(65) Prior Publication Data

US 2012/0176287 A1 Jul. 12, 2012

Related U.S. Application Data

(60) Provisional application No. 61/432,136, filed on Jan. 12, 2011.

(51) Int. Cl.

| | |
|---|---|
| ***H01Q 13/00*** | (2006.01) |
| ***H01Q 15/00*** | (2006.01) |
| ***H01Q 1/38*** | (2006.01) |
| ***H01Q 13/02*** | (2006.01) |

(52) U.S. Cl.

CPC ..... *H01Q 15/0086* (2013.01); *H01Q 1/38* (2013.01); *H01Q 13/02* (2013.01)

(58) Field of Classification Search

CPC H01Q 13/00; H01Q 13/0208; H01Q 13/0216

USPC ..... 343/786, 783; 361/748–751, 780–795; 174/250–268

See application file for complete search history.

(56) References Cited

U.S. PATENT DOCUMENTS

| | | | | |
|---|---|---|---|---|
| 5,363,105 | A * | 11/1994 | Ono et al. | 342/20 |
| 2002/0011964 | A1 * | 1/2002 | Yuanzhu | 343/786 |
| 2005/0044517 | A1 * | 2/2005 | Seaman et al. | 716/8 |
| 2005/0083241 | A1 | 4/2005 | Zarro et al. | |
| 2005/0231436 | A1 * | 10/2005 | McLean et al. | 343/786 |
| 2006/0071876 | A1 * | 4/2006 | Clymer et al. | 343/911 R |
| 2007/0279309 | A1 * | 12/2007 | Schultheiss et al. | 343/786 |
| 2009/0213022 | A1 * | 8/2009 | Lier et al. | 343/785 |
| 2009/0284429 | A1 | 11/2009 | Lier et al. | |
| 2009/0289863 | A1 * | 11/2009 | Lier | 343/753 |
| 2010/0078203 | A1 * | 4/2010 | Lier | 174/258 |
| 2010/0231464 | A1 | 9/2010 | Huang et al. | |
| 2010/0283705 | A1 | 11/2010 | Achour et al. | |

FOREIGN PATENT DOCUMENTS

JP 2004-043931 A 2/2004

* cited by examiner

*Primary Examiner* — Dameon E Levi
*Assistant Examiner* — Collin Dawkins
(74) *Attorney, Agent, or Firm* — McDermott Will & Emery LLP

(57) ABSTRACT

A new class of feed horns is provided based on the use of metamaterial printed circuit board (PCB) liners on the walls of the feed horns. These feed horns may be implemented to achieve low cost operation. PCBs making up the metamaterial liner may be assembled together in such a manner as to form a feed horn with a square or rectangular aperture shape, although other suitable shapes are possible. These PCBs may be fabricated from standard low cost, off-the-shelf dielectric material. A conductor artwork pattern on the PCB surface forming the interior surface of the feed horn can be designed such that the PCB feed horn yields radio frequency (RF) properties similar to that of a corrugated feed horn. A simple flat plate ground plane bonded to the back side of the PCB can serve as the feed horn structure.

20 Claims, 7 Drawing Sheets

PRINTED CIRCUIT BOARD BASED FEED HORN

CROSS-REFERENCE TO RELATED APPLICATIONS

The present application claims the benefit of U.S. Provisional Patent Application Ser. No. 61/432,136, entitled "PRINTED WIRING BOARD BASED FEED HORN," filed on Jan. 12, 2011, which is hereby incorporated by reference in its entirety for all purposes.

STATEMENT REGARDING FEDERALLY SPONSORED RESEARCH OR DEVELOPMENT

Not applicable.

FIELD OF THE INVENTION

The subject technology relates in general to feed horns, and more particularly to high performance, low mass, affordable printed circuit board based feed horns.

BACKGROUND

High performance antenna systems such as those of the space communications industry (e.g., for ground terminal antennas or onboard a spacecraft) may require antenna feeds that are wide in bandwidth, exhibit low sidelobes, and exhibit low cross polarization. Typically, custom designed corrugated feed horns that are machined from solid blocks of metal may be utilized in such systems (e.g., to achieve required bandwidth and radio frequency performance). While corrugated feed horns solve the performance demands of these systems, the horns may be expensive and heavy. In particular, for the (super)-extended C-band (e.g., 3.4 to 4.2 gigahertz and 5.85 to 6.725 gigahertz), the requirements can only be met by the use of ring loaded corrugations in the throat of a horn, resulting in high cost and weight.

SUMMARY

Aspects of the subject technology provide a new class of feed horns based on the use of metamaterial printed wiring board (PWB) or printed circuit board (PCB) liners on the walls of the feed horns. These feed horns may be implemented to achieve low cost operation. In some aspects, PCBs making up the metamaterial liner may be assembled together in such a manner as to form a feed horn with a square or rectangular aperture shape, although other suitable shapes are possible. These PCBs may be fabricated from standard low cost, off-the-shelf dielectric material. A conductor artwork pattern on the PCB surface forming the interior surface of the feed horn can be designed such that the PCB feed horn yields radio frequency (RF) properties similar to that of a corrugated feed horn. In some aspects, a simple flat plate ground plane bonded to the back side of the PCB can serve as the feed horn structure.

According to various aspects of the subject technology, a new class of feed horns based on the use of metamaterial printed circuit board (PCB) liners on the inner surface of the feed horns is provided. A feed horn comprises an outer layer having an inner surface. The feed horn also comprises a layer of printed circuit board lining at least a portion of the inner surface of the outer layer, wherein the layer of printed circuit board is a metamaterial for manipulating propagation of electromagnetic waves.

According to various aspects of the subject technology, the layer of printed circuit board lines substantially the entire inner surface of the outer layer. The layer of printed circuit board is flexible, rigid or semi rigid. The layer of printed circuit board comprises at least one of a dielectric and a metal. The layer of printed circuit board has metal traces printed thereon. The dielectric is further comprised of at least one of a ceramic, a glass or a polymer-based material.

According to various aspects of the subject technology, the feed horn is used to transmit and/or receive electromagnetic waves. The layer of printed circuit board is either a single layer of printed circuit board, a multi layer of printed circuit boards or a printed circuit board with multi layers. The feed horn may further comprise a dielectric layer with an effective index of refraction above 1. A cross section of the outer layer is either circular, elliptical, square, rectangular, hexagonal, octagonal or any shape with n-fold symmetry, wherein n is an integer. The feed horn is either directly radiating or serving as a feed to a reflector. Further, the feed horn's operating frequency range is from UHF (Ultra High Frequency) to THz (terahertz). The feed horn may be used for space, airborne or terrestrial applications. The layer of printed circuit board covers either all of the inner surface of the outer layer, or part of the inner surface of the outer layer. Further, the layer of printed circuit board has an effective index of refraction between 0 and 1 in all or part of an operating frequency range. Still further, the layer of printed circuit board is a low loss tangent material and not an absorber.

According to various aspects of the subject technology, the feed horn's outer layer may comprise four walls so that a cross section of the outer layer is rectangular. Further, the layer of printed circuit board only lines the inner surface of two of the four walls that are opposite to each other, and the layer of printed circuit board does not line the inner surface of the other two walls.

According to various aspects of the subject technology, a feed horn comprises one or more horn walls. At least one of the one or more horn walls comprises a layer of printed circuit board, wherein the layer of printed circuit board is a metamaterial for manipulating propagation of electromagnetic waves. In one embodiment, all the feed horn walls are made up entirely of printed circuit boards. In another embodiment, the one or more horn walls are all electrically connected together.

According to various aspects of the subject technology, a new class of power combiner assembly based on the use of metamaterial printed circuit board (PCB) liners on the inner surface of a feed horn is provided. A power combiner assembly comprises a plurality of power amplifiers and a feed horn comprising an outer layer having an inner surface. The feed horn further comprises a layer of printed circuit board lining substantially the entire inner surface of the outer layer, wherein the layer of printed circuit board is a metamaterial for manipulating propagation of electromagnetic waves. Further, the plurality of power amplifiers are configured to provide power to the feed horn and the feed horn is configured to combine the power from the plurality of power amplifiers into a single power transmission.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

Figure 1A:
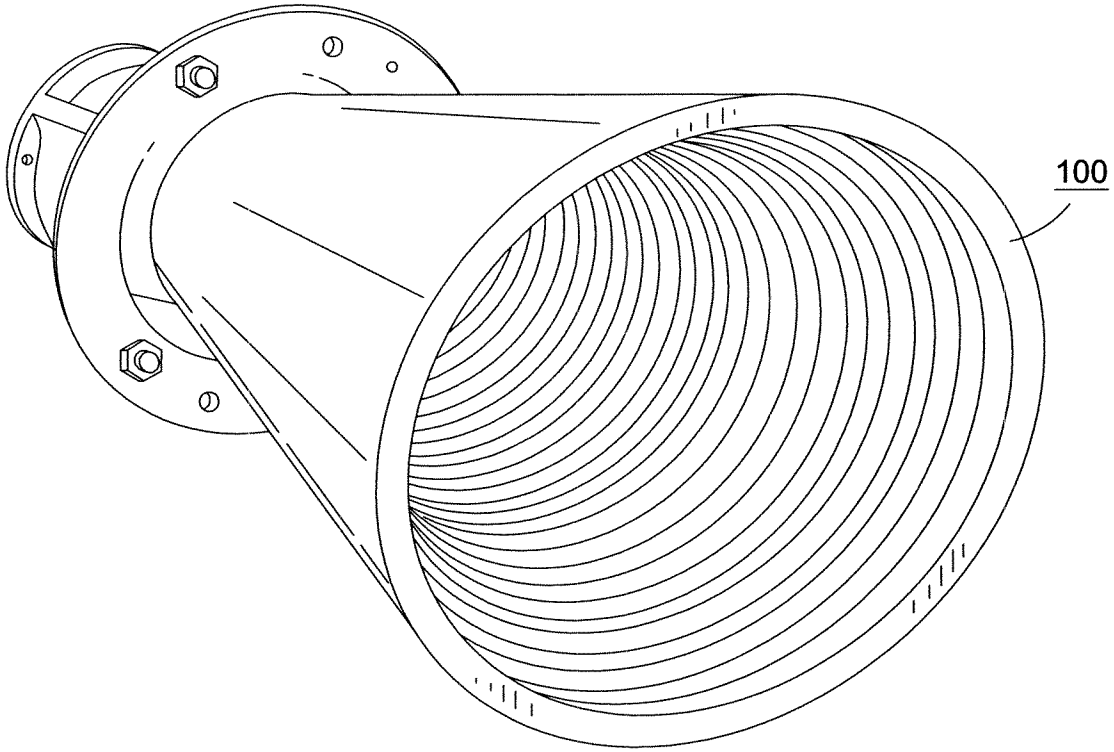
Fig. 1A (Prior Art)
FIG. 1A illustrates the front view of an example of a prior art feed horn. The prior art example shown is a custom designed corrugated feed horn that is machined from a solid block of metal.
Figure 1B:
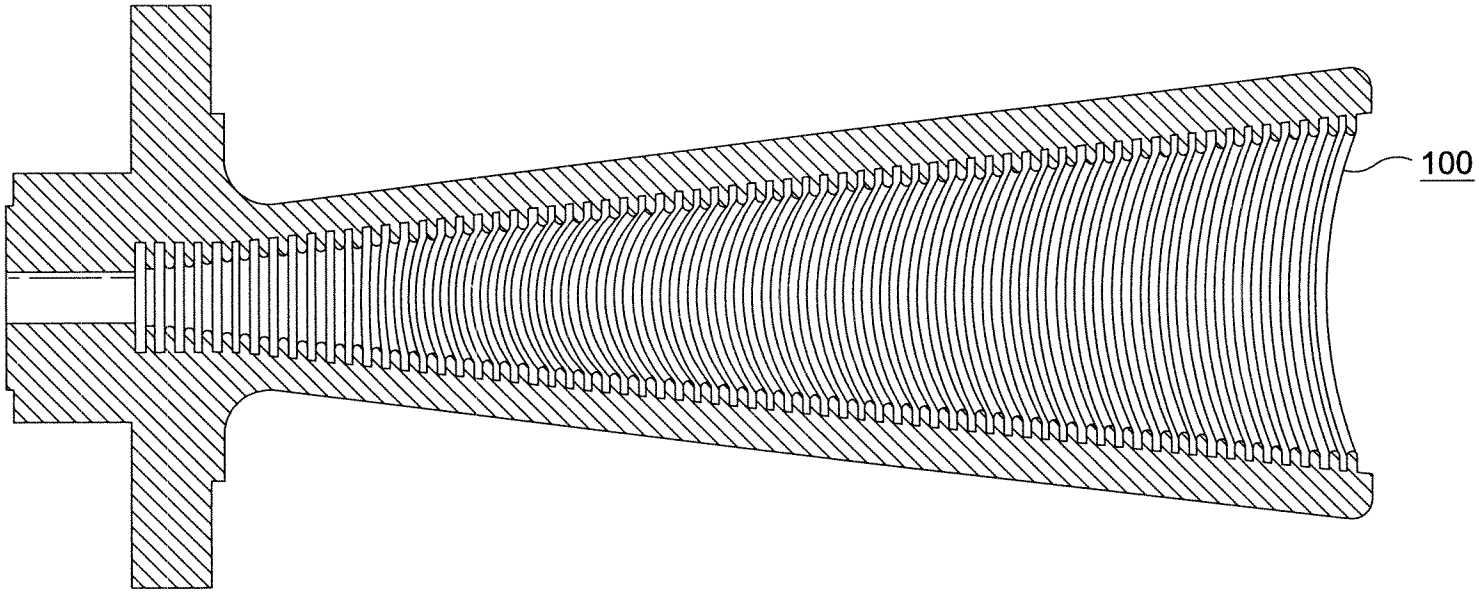
Fig. 1B (Prior Art)
FIG. 1B illustrates the side view of an example of a prior art feed horn that has been cross sectioned for inspection. The prior art example shown is a custom designed corrugated feed horn that is machined from a solid block of metal.

FIGS. 1A and 1B illustrate an example of a prior art feed horn. The example shown is a custom designed corrugated feed horn 100 that is machined from a solid block of metal. FIG. 1A provides a front view of the custom designed corrugated feed horn 100, while FIG. 1B provides a side view of the custom designed corrugated feed horn 100 that has been cross sectioned for inspection. This type of custom designed corrugated feed horn is typically used in high performance antenna systems such as those of the space communications industry (e.g., for ground terminal antennas or onboard a spacecraft), which demand antenna feeds that are wide in bandwidth, exhibit low sidelobes, and exhibit low cross polarization. While these custom designed corrugated feed horns meet the performance demands of the high performance antenna systems, they are often machined from solid blocks of metal and/or are sequentially fabricated in a layered fashion, resulting in high cost and high "overhead" mass needed for the deep grooves. As such, there is a need for reduction in both the cost and weight of feed horns.

Figure 2A:
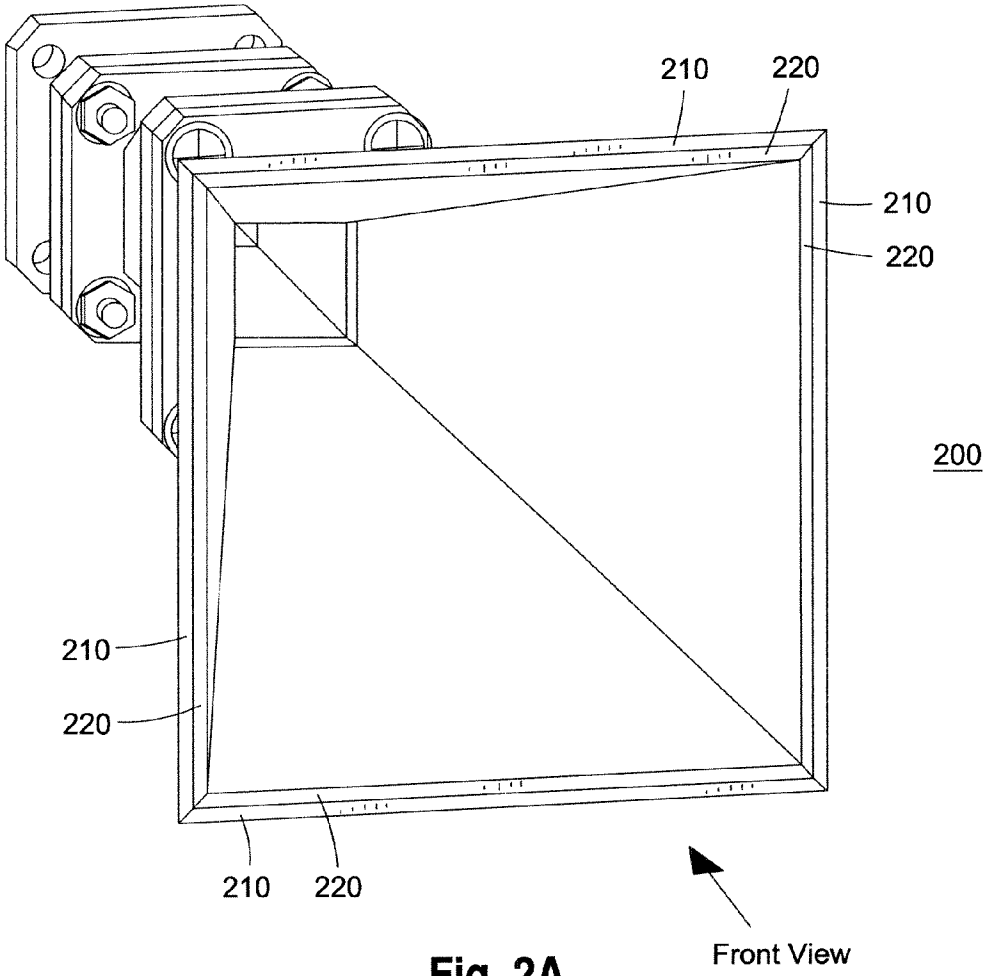
FIG. 2A illustrates the front view of a first example of a PCB based feed horn.
Figure 2B:
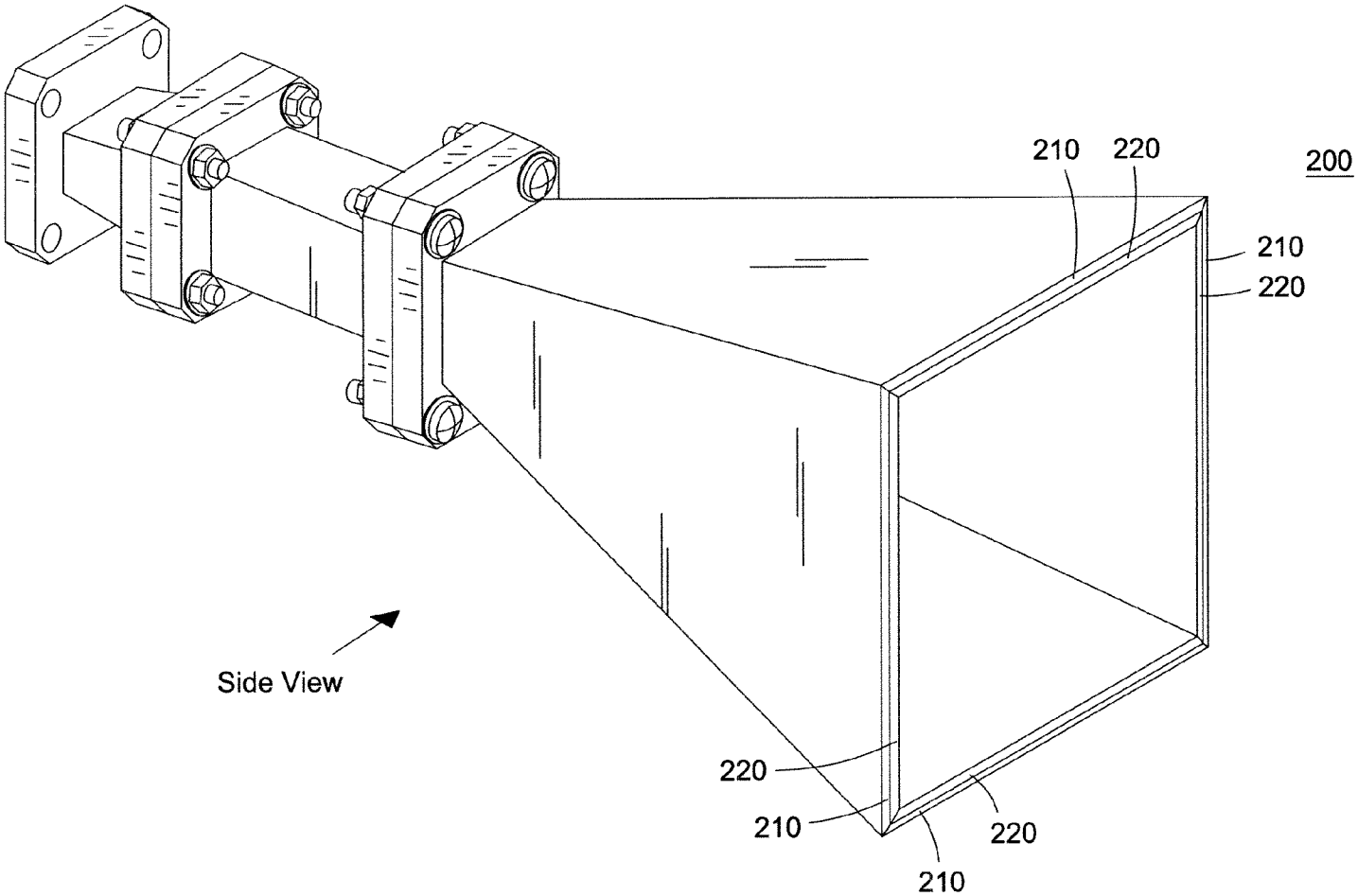
FIG. 2B illustrates the side view of a first example of a PCB based feed horn.

FIGS. 2A and 2B illustrate a first example of a PCB based feed horn 200, which achieves reduction in both cost and weight over prior art feed horn. FIG. 2A provides a front view of a PCB based feed horn 200, while FIG. 2B gives the side view of a PCB based feed horn 200. Both FIG. 2A and FIG. 2B show that PCB based feed horn 200 is comprised of an outer layer 210 and an inner PCB layer 220. In other words, feed horn 200 may be characterized as comprising of an outer layer 210 having an inner surface and a layer 220 of PCB lining substantially the entire inner surface of the outer layer 210. In one embodiment, the outer layer 210 may be a metal ground plate that is conductive electrically. It is not shown here, but another embodiment may have a layer of PCB lining only a portion of the inner surface of the outer layer 210. For example, if a feed horn was used for linearly polarized electromagnetic waves, then a layer of PCB may only line the inner surface of two of the four walls that are opposite to each other. In that example, no PCB layer will be lining the inner surface of the other two remaining walls. In this regard the feed horn embodiment shown in FIG. 2 has a square-shaped aperture or cross section, so the feed horn has four walls.

Figure 3:
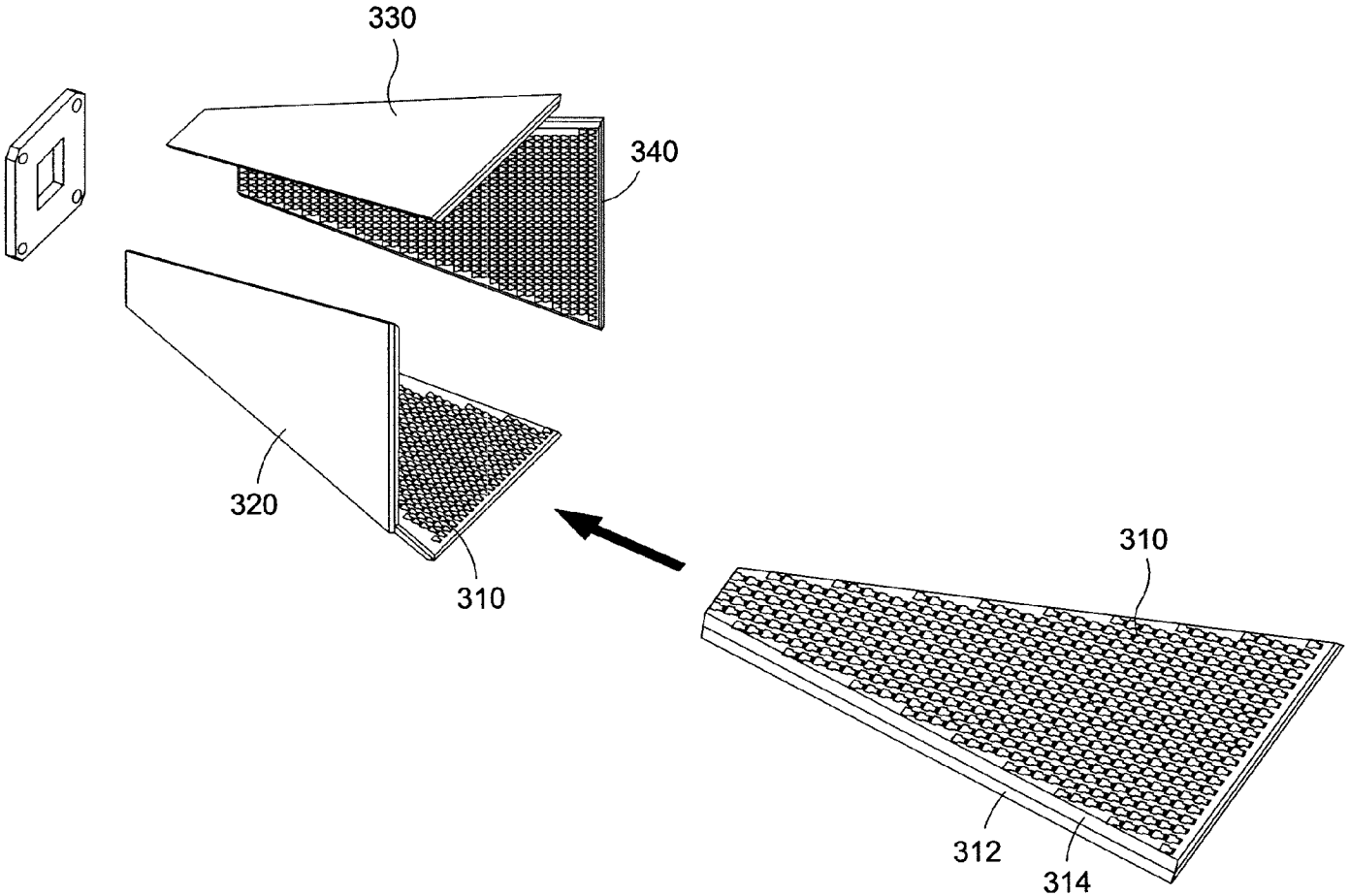
FIG. 3 illustrates how PCB based parts may be formed by lining the inner surface of an outer layer with a layer of PCB (printed circuit board).

FIG. 3 illustrates how PCB based parts may be formed by lining the inner surface of an outer layer with a layer of PCB (printed circuit board). Here, a PCB based feed horn is to be fabricated from PCB based parts 310, 320, 330, and 340. As the feed horn embodiment shown in FIG. 3 will have a square-shaped aperture or cross section, there will be four walls to the feed horn, corresponding to the four PCB based parts 310, 320, 330, and 340. For illustrative purposes, PCB based part 310 is blown up to show the details of outer layer 312 and PCB layer 314. FIG. 3 shows the outer layer 312 as a simple flat plate that is bonded to the back side of the PCB layer 314. Outer layer 312 serves as the feed horn structure support in this example. One may also characterize the outer layer 312 as a ground plane, as outer layer 312 is made up of metal and is electrically conductive. Further, there is an artwork pattern of metal traces printed on the PCB layer 314, facing toward the inside of the feed horn and forming an interior "metamaterial" feed horn surface.

According to various aspects of the subject technology, the feed horn shown is made up of a ground plane and a layer of PCB. This feed horn may use materials and fabrication techniques common in the PCB industry. Because the PCB and ground plane may be fabricated using common PCB processes, the cost of the horn as compared to that of a similar horn of corrugated construction is drastically reduced. The PCB conductive pattern may be designed using standard PCB design tools. In addition, the pattern for the entire horn may be photo etched in a single process step.

In some aspects, the flat ground plane 312 may be optimally designed, meeting structural requirements with the lowest cost/mass solution. The flat plate ground plane 312 and PCB layer 314 may weigh much less than a machined corrugated horn.

Figure 4:
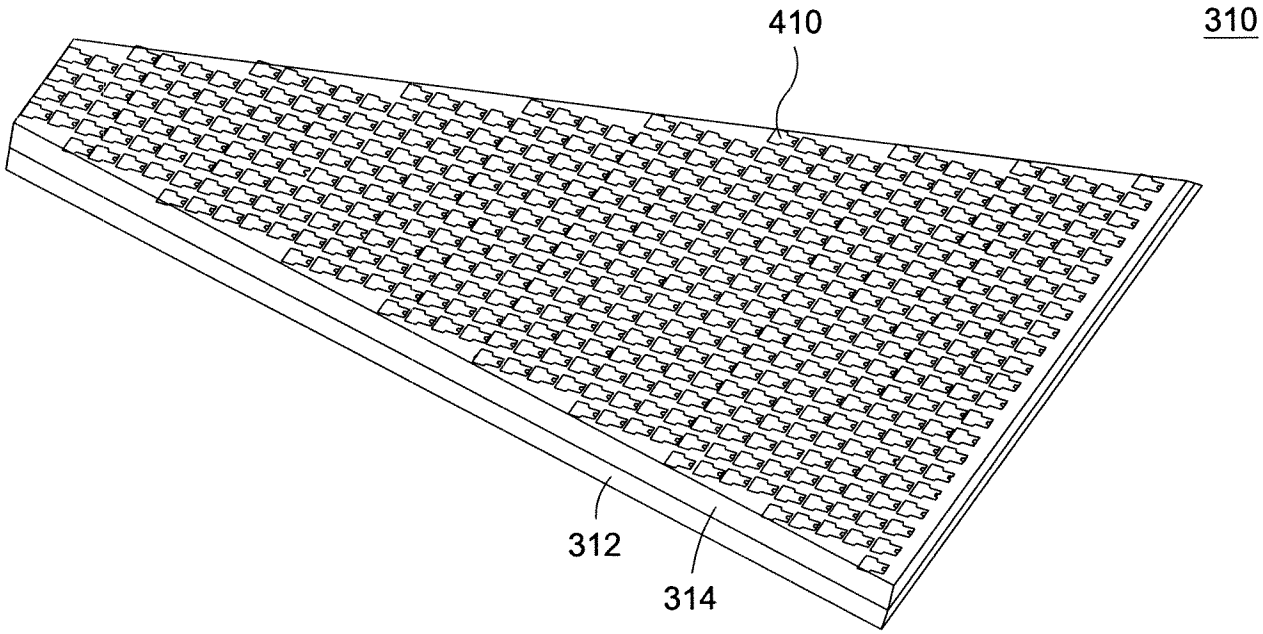
FIG. 4 illustrates how artwork pattern of metal trace printed on PCB based parts may form an interior 'metamaterial' feed horn surface.

In FIG. 4, PCB based part 310 is further enlarged to show how an artwork pattern of metal traces printed on PCB based parts may form an interior 'metamaterial' feed horn surface. FIG. 4 shows PCB layer 314 sitting on top of conducting outer layer 312, which is a simple flat metal plate ground plane in this example. On top of PCB based part 314, a unit metal trace FIG. 410 is repeated in a regular pattern over the surface of PCB layer 314. In one embodiment, these unit metal trace figures are all connected to a copper backside plate of the PCB through individual metal vias for each unit metal trace figure. Surrounding the metal vias is dielectric material. As this is an example, other artwork pattern of metal trace printed on PCB based parts may also form an interior 'metamaterial' feed horn surface.

Figure 5:
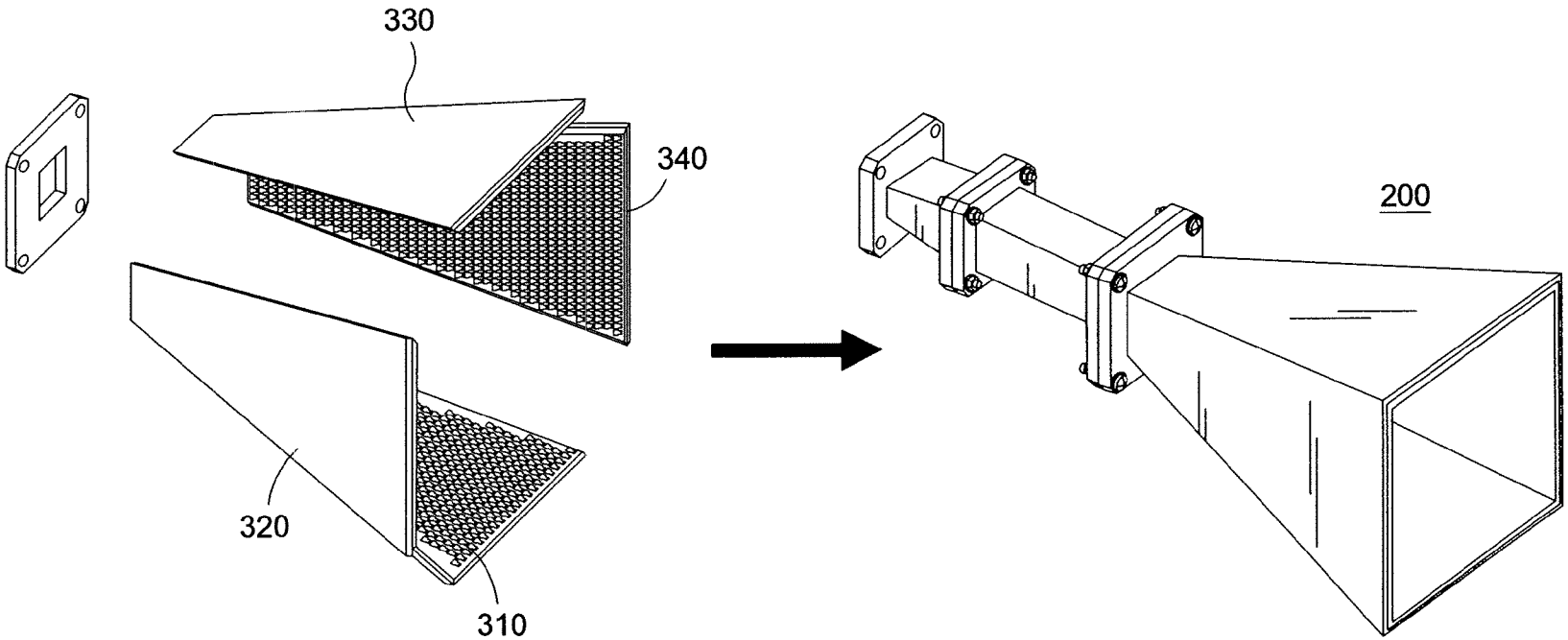
FIG. 5 illustrates how PCB based parts may be assembled together to form a first example of a PCB based feed horn.

FIG. 5 illustrates how PCB based parts may be assembled together to form a first example of a PCB based feed horn. Here, PCB based parts 310, 320, 330, and 340 are assembled together to form PCB based feed horn 200.

In some aspects, the low cost PCBs and ground planes, made of common materials and processes, can be laminated by PCB suppliers. Additionally, the PCB walls (i.e., PCB based parts 310, 320, 330, and 340) may be welded or bolted together, providing the needed structural integrity. In some embodiments where the welded or bolted together PCB walls are able provide adequate structural support for the feed horn, it may be possible to construct the feed horn without the use of the metal plate ground plane from the outer layer 312. In those embodiments, the copper backside plate of the PCB will serve as the ground plane.

In some aspects, horns with square apertures, as shown in FIG. 5, may yield very similar performance as horns with circular apertures (i.e., conical horns). The conductor artwork pattern on the PCB surface forming the interior surface of the feed horn (as shown in FIG. 4) can be designed such that the PCB feed horn yields RF properties similar to that of a corrugated feed horn, with the potential for even larger bandwidth for multi-band operations (Ku and Ka-band). As such, metamaterial horns may have intrinsically larger bandwidth than corrugated horns, thereby enabling applications with over an octave bandwidth.

The example feed horn shown in FIG. 5 has an aperture that is square. However, horn aperture may be circular, elliptical, square, rectangular, hexagonal or octagonal. In fact, the horn aperture may be any shape with n-fold symmetry, where n is an integer.

Returning to the example where the feed horn was used for linearly polarized electromagnetic waves, a feed horn with both a square or a rectangular aperture, having four horn walls, may be utilized. In that embodiment, a layer of PCB may only line the inner surface of two of the four walls that are opposite to each other. As such, horn walls 320 and 340 may be lined with a layer of PCB, while horn walls 310 and 330 remain free of PCB. Alternatively, horn walls 310 and 330 may be lined with a layer of PCB, while horn walls 320 and 340 remain free of PCB.

In some aspects, the subject technology may be used in various markets, including for example and without limitation, advanced sensors, data transmission and communications, and radar and active phased arrays markets.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as an "aspect" may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such an "embodiment" may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is the following:

1. A feed horn comprising:

one or more printed circuit boards forming all outer walls of the feed horn such that the one or more printed circuit boards form the entire outer walls of the feed horn, the one or more printed circuit boards having a trace pattern on an interior surface of the feed horn, the one or more printed circuit boards comprising a conductive outer layer on an exterior surface of the feed horn, the trace pattern connected to the conductive outer layer through a via, wherein the trace pattern forms a metamaterial on the interior surface of the feed horn for manipulating propagation of electromagnetic waves.

2. The feed horn of claim 1, wherein the trace pattern spans substantially the entire interior surface of the feed horn.

3. The feed horn of claim 1, wherein at least one of the one or more printed circuit boards is flexible, rigid or semi rigid.

4. The feed horn of claim 1, wherein at least one of the one or more printed circuit boards comprises at least one of a dielectric and a metal.

5. The feed horn of claim 1, wherein the trace pattern comprises metal traces printed on at least one of the one or more printed circuit boards.

6. The feed horn of claim 4, wherein the dielectric comprises at least one of a ceramic, a glass or a polymer-based material.

7. The feed horn of claim 1, wherein the feed horn is used to transmit and/or receive electromagnetic waves.

8. The feed horn of claim 1, wherein at least one of the one or more printed circuit boards is either a single layer of printed circuit board, a multi layer of printed circuit boards or a printed circuit board with multi layers.

9. The feed horn of claim 1, wherein at least one of the one or more printed circuit boards further comprises a dielectric layer with an effective index of refraction above 1.

10. The feed horn of claim 1, wherein a cross section of the feed horn is either circular, elliptical, square, rectangular, hexagonal, octagonal or any shape with n-fold symmetry, wherein n is an integer.

11. The feed horn of claim 1, wherein the feed horn is either directly radiating or serving as a feed to a reflector.

12. The feed horn of claim 1, wherein the feed horn's operating frequency range is from UHF (Ultra High Frequency) to THz (terahertz).

13. The feed horn of claim 1, wherein at least one of the one or more printed circuit boards has an effective index of refraction between 0 and 1 in all or part of an operating frequency range.

14. The feed horn of claim 1, wherein the one or more printed circuit boards are a low loss tangent material and not an absorber.

15. The feed horn of claim 1, wherein the one or more printed circuit boards comprise four printed circuit boards so that a cross section of the feed horn is rectangular, wherein the trace pattern is formed on only the interior surface of two of the four printed circuit boards that are opposite to each other and the trace pattern is not formed on the interior surface of the other two printed circuit boards.

16. A feed horn comprising:

a plurality of outer horn walls, wherein each of the plurality of outer horn walls comprises a printed circuit board such that each entire outer horn wall comprises the respective printed circuit board, wherein each printed circuit board comprises a conductive layer, a dielectric layer, and a conductive trace, wherein the conductive trace is disposed on the dielectric layer opposite the conductive layer, wherein the conductive trace is connected to the conductive layer through a via extending through the dielectric layer, and wherein each conductive trace forms a metamaterial on an interior surface of the feed horn for manipulating propagation of electromagnetic waves.

17. The feed horn of claim 16, wherein the plurality of horn walls are all electrically connected together.

18. The feed horn of claim 16, wherein each printed circuit board is flexible, rigid or semi rigid.

19. The feed horn of claim 16, wherein each printed circuit board comprises at least one of a dielectric and a metal.

20. An antenna system comprising:

a feed horn comprising at least one rigid printed circuit board forming all entire outer walls of the feed horn, wherein the at least one rigid printed circuit board comprises a conductive layer, a dielectric layer, and a plurality of unit metal traces, wherein the plurality of unit metal traces is disposed on the dielectric layer opposite the conductive layer, wherein each of the plurality of unit metal traces is connected to the conductive layer through a respective one of a plurality of individual vias, and wherein the plurality of unit metal traces forms a metamaterial on an interior surface of the feed horn for manipulating propagation of electromagnetic waves.

* * * * *